US012435399B2

(12) United States Patent
Lee et al.

(10) Patent No.: US 12,435,399 B2
(45) Date of Patent: Oct. 7, 2025

(54) NON-ORIENTED ELECTRICAL STEEL SHEET AND MANUFACTURING METHOD THEREFOR

(71) Applicant: POSCO, Pohang-si (KR)

(72) Inventors: Se Il Lee, Gyeongsangbuk-do (KR); Hyunwoo Mun, Gyeongsangbuk-do (KR)

(73) Assignee: POSCO, Pohang-si (KR)

( * ) Notice: Subject to any disclaimer, the term of this patent is extended or adjusted under 35 U.S.C. 154(b) by 493 days.

(21) Appl. No.: 17/784,444

(22) PCT Filed: Dec. 17, 2020

(86) PCT No.: PCT/KR2020/018616
§ 371 (c)(1),
(2) Date: Jun. 10, 2022

(87) PCT Pub. No.: WO2021/125862
PCT Pub. Date: Jun. 24, 2021

(65) Prior Publication Data

US 2023/0021013 A1 Jan. 19, 2023

(30) Foreign Application Priority Data

Dec. 19, 2019 (KR) ..... 10-2019-0170755

(51) Int. Cl.

| | |
|---|---|
| ***C22C 38/08*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |

(52) U.S. Cl.
CPC ..... *C22C 38/08* (2013.01); *C21D 8/0205* (2013.01); *C21D 8/0226* (2013.01); *C21D 8/0236* (2013.01); *C21D 9/46* (2013.01); *C22C 38/002* (2013.01); *C22C 38/008* (2013.01); *C22C 38/02* (2013.01); *C22C 38/04* (2013.01); *C22C 38/06* (2013.01); *C22C 38/16* (2013.01)

(58) Field of Classification Search
CPC ..... C22C 38/08; C22C 38/002; C22C 38/008; C22C 38/02; C22C 38/04; C22C 38/06; C22C 38/16; C22C 38/001; C22C 38/60; C22C 38/004; C21D 8/0205; C21D 8/0226; C21D 8/0236; C21D 9/46; C21D 1/26; C21D 6/005; C21D 6/008; C21D 8/1222; C21D 8/1233; C21D 8/1261; C21D 8/1272; C21D 8/1283
See application file for complete search history.

(56) References Cited

U.S. PATENT DOCUMENTS

| | | | |
|---|---|---|---|
| 2016/0203985 | A1 | 7/2016 | Nakanishi et al. |
| 2017/0211161 | A1 | 7/2017 | Nakanishi et al. |

FOREIGN PATENT DOCUMENTS

| | | | | | |
|---|---|---|---|---|---|
| CN | 104039998 | A | | 9/2014 | |
| CN | 106574345 | A | | 4/2017 | |
| CN | 107075640 | A | | 8/2017 | |
| CN | 107109570 | A | | 8/2017 | |
| CN | 115003845 | B | | 10/2023 | |
| JP | H11-61359 | A | | 3/1999 | |
| JP | 2001-271147 | A | | 10/2001 | |
| JP | 2005-113185 | A | | 4/2005 | |
| JP | 2005-200713 | A | | 7/2005 | |
| JP | 2005-290514 | A | | 10/2005 | |
| JP | 2005-330527 | A | | 12/2005 | |
| JP | 2008-132534 | A | | 6/2008 | |
| JP | 2010-174376 | A | | 8/2010 | |
| JP | 2016-125134 | A | | 7/2016 | |
| JP | 2017-057462 | A | | 3/2017 | |
| JP | 2017-088968 | A | | 5/2017 | |
| JP | 2018-070955 | A | | 5/2018 | |
| KR | 10-2011-0097525 | A | | 8/2011 | |
| KR | 10-2016-0073222 | A | | 6/2016 | |
| KR | 2016073222 | A | * | 6/2016 | ..... C21D 8/12 |
| KR | 10-1728028 | B1 | | 4/2017 | |
| KR | 10-2018-0070949 | A | | 6/2018 | |
| WO | 2016/027445 | A1 | | 2/2016 | |
| WO | 2019/132426 | A1 | | 7/2019 | |

OTHER PUBLICATIONS

KR-2016073222-A: Espacenet English machine translation (Year: 2016).*

Japanese Office Action dated Sep. 12, 2023 issued in Japanese Patent Application No. 2022-537553.

International Search Report (with partial English translation) dated Apr. 28, 2021 issued in International Patent Application No. PCT/KR2020/018616.

Chinese Office Action dated Feb. 15, 2023 issued in Chinese Patent Application No. 202080094655.3.

Extended European Search Report dated Apr. 25, 2023 issued in European Patent Application No. 20901727.6.

* cited by examiner

*Primary Examiner* — Adil A. Siddiqui
(74) *Attorney, Agent, or Firm* — Morgan Lewis & Bockius LLP

(57) ABSTRACT

A non-oriented electrical steel sheet according to an embodiment of the present invention includes, in wt %, Si: 1.5% or less, C: 0.01% or less (excluding 0%), Mn: 0.03 to 3%, P: 0.01 to 0.2%, S: 0.001 to 0.02%, Al: 0.01% or less (excluding 0%), N: 0.005% or less (excluding 0%), Cu: 0.02 to 0.3%, 0.0001 to 0.005 wt % of Ca and Mg either alone or in total, 0.001 to 0.2 wt % of Sb and Sn either alone or in total, and a balance of Fe and inevitable impurities.

5 Claims, No Drawings

NON-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/018616, filed on Dec. 17, 2020, which in turn claims the benefit of Korean Application No. 10-2019-0170755, filed on Dec. 19, 2019, the entire disclosures of which applications are incorporated by reference herein.

TECHNICAL FIELD

The present invention relates to a non-oriented electrical steel sheet and a manufacturing method therefor. Specifically, the present invention relates to a non-oriented electrical steel sheet and a manufacturing method therefor that may improve magnetic flux density by forming a large number of ferrite textures that are advantageous for magnetism through segregation of S and P in a steel component to which Cu is added.

BACKGROUND ART

A non-oriented electrical steel sheet is used as a material for an iron core in rotary devices such as motors and generators, and stationary devices such as small transformers, and plays an important role in determining energy efficiency in electric devices. Recently, the use of high-efficiency motors has significantly increased due to the strengthening of motor efficiency regulations. In order to improve the efficiency of such motors, it is necessary to lower iron loss thereof or lower copper loss thereof. Both of these methods may significantly affect the magnetism of the electrical steel sheet, which is a core material. Accordingly, motor manufacturers tend to use electrical steel sheets with low iron loss instead of electrical steel sheets with high iron loss. In order to reduce copper loss, a method of making design magnetic flux density lower than existing magnetic flux density or lowering an excitation current in the design magnetic flux is used, and in this case, in order to use the latter method, it is necessary to improve the magnetic flux density of the electrical steel sheet. Particularly, since an electrical steel sheet having high magnetic flux density may improve torque, when it is applied to a motor with frequent on/off, large output may be generated in a short time. As an electrical steel sheet having high magnetic flux density, for example, a non-oriented electrical steel sheet in which Si content is reduced and Ni is added in a large amount is known. However, since a stable temperature of austenite is lowered according to the addition of Ni, a temperature at which heat treatment may be performed on ferrite is lowered. Accordingly, high temperature annealing, which is advantageous for iron loss and magnetism, is impossible. In addition, there is a problem of high iron loss because the content of Si, which is an element that increases resistivity, is low. Therefore, it is necessary to develop a non-oriented electrical steel sheet having an increased magnetic flux density while having low iron loss without causing an increase in manufacturing cost. In addition, when the motor rotates, an excitation direction rotates within a plate plane, and in this case, generally, the best magnetism is formed in a rolling direction, and the worst magnetism is formed in a 45 degree direction from the rolling direction. Therefore, an electrical steel sheet of which both the magnetic properties in the rolling direction and in the direction diagonal to the rolling direction are excellent is extremely advantageous for improving the motor efficiency compared to an electrical steel sheet of which the magnetic properties only in the rolling direction is excellent, and since a difference in magnetism in two directions is small, a small difference in magnetism in each direction is preferred for a motor based on a rotating body.

DISCLOSURE

Description of the Drawings

Technical Problem

An embodiment of the present invention is to provide a non-oriented electrical steel sheet and a manufacturing method therefor. Specifically, an embodiment of the present invention is to provide a non-oriented electrical steel sheet and a manufacturing method therefor that may improve magnetic flux density by forming a large number of ferrite textures that are advantageous for magnetism through segregation of S and P in a steel component to which Cu is added.

Technical Solution

An embodiment of the present invention provides a non-oriented electrical steel sheet includes, in wt %, Si: 1.5% or less, C: 0.01% or less (excluding 0%), Mn: 0.03 to 3%, P: 0.005 to 0.2%, S: 0.001 to 0.02%, Al: 0.7% or less (excluding 0%), N: 0.005% or less (excluding 0%), Cu: 0.02 to 0.06%, 0.0001 to 0.005 wt % of Ca and Mg either alone or in total, 0.02 to 0.2 wt % of Sb and Sn either alone or in total, and a balance of Fe and inevitable impurities.

The non-oriented electrical steel sheet according to the embodiment of the present invention may include Mg at 0.0001 to 0.003 wt %.

The non-oriented electrical steel sheet according to the embodiment of the present invention may include Sn at 0.01 to 0.1 wt % and Sb at 0.001 to 0.1 wt %.

The non-oriented electrical steel sheet according to the embodiment of the present invention may further include Ni at 0.05 wt % or less.

An average grain size of the non-oriented electrical steel sheet according to the embodiment of the present invention may be 13 to 100 μm.

In the non-oriented electrical steel sheet according to the embodiment of the present invention, an average of magnetic flux density B50L in a rolling direction and magnetic flux density B50C in a direction forming a 90 degree angle to the rolling direction may be 1.76 T or more, and a ratio (B50L/B50D) of the magnetic flux density B50L in the rolling direction and the magnetic flux density B50D in the direction forming a 45 degree angle to the rolling direction may be 1.07 or less.

Another embodiment of the present invention provides a manufacturing method of a non-oriented electrical steel sheet including: a step of heating a slab that includes, in wt %: Si: 1.5% or less, C: 0.01% or less (excluding 0%), Mn: 0.03 to 3%, P: 0.01 to 0.2%, S: 0.001 to 0.02%, Al: 0.7% or less (excluding 0%), N: 0.005% or less (excluding 0%), Cu: 0.02 to 0.06%, 0.0001 to 0.005 wt % of Ca and Mg either alone or in total, 0.02 to 0.2 wt % of Sb and Sn either alone or in total, and a balance of Fe and inevitable impurities; a step of manufacturing a hot-rolled sheet by hot-rolling the slab; a step of manufacturing a cold-rolled sheet by cold-rolling the hot-rolled sheet; and a step of final-annealing of the cold-rolled sheet.

A thickness of the hot-rolled sheet may be 2.0 to 3.5 mm.

A thickness of the cold-rolled sheet may be 0.3 to 1.0 mm.

Advantageous Effects

According to the non-oriented electrical steel sheet according to the embodiment of the present invention, it is possible to improve magnetic flux density by forming a large number of ferrite textures that are advantageous for magnetism through segregation of S and P in a steel component to which Cu is added.

In addition, it is possible to improve anisotropy of the magnetic flux density.

In addition, the non-oriented electrical steel sheet according to the embodiment of the present invention may be variously used for core materials of a high-efficiency motor or a high-output and high-torque motor, and for a generator.

MODE FOR INVENTION

The terminologies used herein are used just to illustrate a specific exemplary embodiment, but are not intended to limit the present invention. An expression used in the singular encompasses an expression of the plural, unless it has a clearly different meaning in the context. It will be further understood that the term "comprises" or "includes", used in this specification, specifies stated properties, regions, integers, steps, operations, elements, and/or components, but does not preclude the presence or addition of other properties, regions, integers, steps, operations, elements, components, and/or groups.

When referring to a part as being "on" or "above" another part, it may be positioned directly on or above the other part, or another part may be interposed therebetween. In contrast, when referring to a part being "directly above" another part, no other part is interposed therebetween.

Unless otherwise defined, all terms used herein, including technical or scientific terms, have the same meanings as those generally understood by those with ordinary knowledge in the field of art to which the present invention belongs. Terms defined in commonly used dictionaries are further interpreted as having meanings consistent with the relevant technical literature and the present disclosure, and are not to be construed as having idealized or very formal meanings unless defined otherwise.

Unless mentioned in a predetermined way, % represents wt %, and 1 ppm is 0.0001 wt %.

In an embodiment of the present invention, inclusion of additional elements in a steel component means replacing the balance of iron (Fe) by an additional amount of the additional elements.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In an embodiment of the present invention, in a steel component to which Cu is added, by forming a large number of ferrite textures that are advantageous for magnetism through segregation of S and P, it is possible to improve magnetic flux density of a non-oriented electrical steel sheet.

A non-oriented electrical steel sheet according to an embodiment of the present invention includes, in wt %: Si: 1.5% or less, C: 0.01% or less (excluding 0%), Mn: 0.03 to 3%, P: 0.01 to 0.2%, S: 0.001 to 0.02%, Al: 0.01% or less (excluding 0%), N: 0.005% or less (excluding 0%), Cu: 0.02 to 0.3%, 0.0001 to 0.005 wt % of Ca and Mg either alone or in total, 0.001 to 0.2 wt % of Sb and Sn either alone or in total, and a balance of Fe and inevitable impurities.

First, the reason for limiting the components of the non-oriented electrical steel sheet will be described.

Si: 1.50 wt % or Less

Silicon (Si) is an element that is effective in increasing intrinsic resistance of steel and reducing iron loss, and the more it is added, the better, but it is an element that forms a BCC structure instead of iron atoms in steel and is a main element that deteriorates magnetic flux density. When a large amount of Si is added, saturation magnetic flux is significantly reduced, and accordingly, B50 magnetic flux density may also deteriorate. Accordingly, Si may be included in the above-mentioned range. Specifically, Si may be included in an amount of 1.00 wt % or less. More specifically, Si may be included in an amount of 0.10 to 0.50 wt %.

C: 0.0100 wt % or Less

Carbon (C) is an element that causes magnetic aging to significantly increase iron loss. Accordingly, C may be included in an amount of 0.0100 wt % or less. Specifically, C may be included in an amount of 0.005 wt % or less. More specifically, C may be included in an amount of 0.0010 to 0.0050 wt %.

Mn: 0.03 to 3.00 wt %

Manganese (Mn) needs to be added in consideration of an amount of Cu added to prevent brittleness during hot-rolling. When Mn is included in an excessively small amount, a problem due to brittleness during hot-rolling may occur. When Mn is included in an excessively large amount, saturation magnetic flux density is lowered, and a ratio of Fe in steel is reduced, thus the saturation magnetic flux density is lowered. Accordingly, Mn may be included in the above-mentioned range. Specifically, Mn may be included in an amount of 0.05 to 1.00 wt %. More specifically, Mn may be included in an amount of 0.10 to 0.50 wt %.

P: 0.01 to 0.20 wt %

Phosphorus (P) works together with Cu and S to improve a texture in a ferrite structure of steel and to increase magnetic flux density. When P is included in an excessively small amount, the above-described effect may not be properly obtained. When too much P is included, P is precipitated alone in the steel, the magnetic flux density is deteriorated, and the brittleness of the steel is maximized, making it difficult to roll the steel. Accordingly, P may be included in the above-mentioned range. Specifically, P may be included in an amount of 0.03 to 0.15 wt %. More specifically, P may be included in an amount of 0.05 to 0.10 wt %.

S: 0.0010 to 0.0200 wt %

Sulfur (S) is an element that segregates at a surface and at a grain boundary. S is an element that helps to improve magnetic flux density and lower anisotropy by affecting development of texture by surface segregation during annealing. When S is included in an excessively small amount, the above-described effect may not be properly obtained. When S is included in an excessively large amount, a large amount of sulfides such as MnS and CuS are formed, and grain growth may be inhibited by the sulfides. As a result, iron loss may be increased. Accordingly, S may be included in the above-mentioned range. Specifically, S may be included in an amount of 0.00150 to 0.0100 wt %. More specifically, S may be included in an amount of 0.0020 to 0.0050 wt %.

Al: 0.700 wt % or Less

Aluminum (Al) is an element that is effective in increasing intrinsic resistance of steel and reducing iron loss, is a ferrite stabilizing element and is a useful element because it may prevent phase transformation to austenite even at a high temperature depending on an added amount thereof, and is an element that significantly increases specific resistance of the steel sheet to the same degree as Si. However, when Al is added in an excessively amount, the saturation magnetic flux is significantly reduced, so that an effective excitation current may be significantly increased when driving a motor after manufacturing the motor. Accordingly, Al may be included in the above-mentioned range. Specifically, Al may be included in an amount of 0.100 wt % or less. More specifically, Al may be included in an amount of 0.005 wt % or less.

N: 0.0050 wt % or Less

Nitrogen (N) is a harmful element that forms nitrides, inhibits grain growth, and increases iron loss. Accordingly, N may be included in an amount of 0.0050 wt % or less. Specifically, N may be included in an amount of 0.0030 wt % or less.

Cu: 0.020 to 0.060 wt %

Copper (Cu) facilitates grain growth during coiling after hot-rolling. In addition, it affects improvement of magnetic flux density by segregation of Sn and S and P at a surface and a grain boundary. In addition, by forming a coarse sulfide by combining with S in final-annealing, iron loss deterioration due to fine MnS is suppressed, so that the magnetic flux density is improved, and the iron loss is reduced, making it possible to manufacture an electrical steel sheet with excellent magnetic properties. When Cu is included in an excessively small amount, the above-described effect may not be properly obtained. When Cu is included in an excessively large amount, it may cause a hot shortening defect at a high temperature, and the magnetic flux density may be deteriorated by forming a Cu secondary phase in the steel. Accordingly, Cu may be included in the above-mentioned range. Specifically, Cu may be included in an amount of 0.020 to 0.050 wt %.

In this case, Cu is one of the most used metal elements, and may be mixed from scrap, which is a raw material of steel, or may be added as an alloying element.

Ca and Mg Alone or in Total: 0.0001 to 0.005 wt %

Calcium (Ca) is an element that forms sulfides and oxides. When Ca is added, the sulfide may be coarsened to promote grain growth. When Ca or Mg is included in an excessively small amount, the above-described effect may not be properly obtained. When Ca is included in an excessively large amount, it is combined with Ca and oxygen in the steel to form precipitates to slow a grain growth rate, and accordingly, a problem of suppressing an effect of controlling texture during annealing by P may occur. Accordingly, Ca, together with Mg, may be added in the above-mentioned range. Specifically, when Ca is included, 0.0005 to 0.005 wt % of Ca may be included. More specifically, Ca may be included in an amount of 0.0005 to 0.0015 wt %.

Magnesium (Mg) acts similar to Ca during annealing in Cu-, S-, and P-added steel. That is, when Mg is added, the sulfide may be coarsened to promote grain growth. When Mg or Ca is included in an excessively small amount, the above-described effect may not be properly obtained. When Mg is added in an excessively large amount, it is possible to suppress an effect of controlling texture during annealing by P. Accordingly, Mg, together with Ca, may be added in the above-mentioned range. Specifically, when Mg is included, 0.0001 to 0.003 wt % of Mg may be included. More specifically, Mg may be included in an amount of 0.0005 to 0.002 wt %.

Since Ca has a similar action to Mg, when they are treated as one element to be included alone, and when each of them is included or all of them are simultaneously included, 0.0001 to 0.005 wt % thereof may be included in the total amount.

That is, when Ca alone is included, 0.0001 to 0.005 wt % of Ca may be included, or when Mg alone is included, 0.0001 to 0.005 wt % of Mg may be included, or when both Ca and Mg are included, 0.0001 to 0.005 wt % of Ca and Mg in the total amount thereof may be included.

Sb and Sn Alone or in Total: 0.02 to 0.2 wt %

Antimony (Sb) and tin (Sn) are both grain boundary segregation elements, and have an effect of improving the magnetic flux density by controlling the texture according to grain growth during annealing. When Sb and Sn are included in an excessively small amount, the above-described effect may not be properly obtained. Particular, in steel to which Cu is added, it induces a texture that significantly improves magnetism by interaction at grain boundaries, and has an effect of benefiting the grain growth. However, when Sb and Sn are included in an excessively large amount, they are segregated at grain boundaries to reduce toughness, thereby reducing productivity compared to magnetic improvement.

Since Sb and Sn have similar actions, when they are treated as one element to be included alone, and when each of them is included or both of them are simultaneously included, 0.02 to 0.2 wt % thereof may be included in the total amount.

That is, when Sb alone is included, 0.02 to 0.2 wt % of Sb may be included, or when Sn alone is included, 0.02 to 0.2 wt % of Sn may be included, or when both Sb and Sn are included, 0.001 to 0.2 wt % of Sb and Sn in the total amount thereof may be included.

Specifically, 0.020 to 0.100 wt % of Sn may be included, and simultaneously, 0.0001 to 0.100 wt % of Sb may be included.

The non-oriented electrical steel sheet according to the embodiment of the present invention may further include Ni at 0.05 wt % or less.

Ni: 0.05 wt % or Less

Nickel (Ni) is known as an element that increases the saturation magnetic flux density. In the embodiment of the present invention, it is possible to sufficiently realize the improvement of the saturation magnetic flux density by the addition of Cu, S, and P, and the addition of Ni rather inhibits the growth of crystal grains, which may cause problems that iron loss is low, and a texture unfavorable to magnetism is formed. Accordingly, when Ni is further included, it may be included in an amount of 0.05 wt % or less. Specifically, Ni may be included in an amount of 0.02 wt % or less.

Other Impurities

In addition to the above-described elements, impurities that are inevitably mixed may be included. The balance is iron (Fe), and when additional elements other than the above-described elements are added, the balance iron (Fe) is replaced and included.

The impurities that are inevitably added may be Cr, Zr, Mo, V, and the like.

Cr may be included in an amount of 0.05 wt % or less. Cu, Ni, and Cr react with impurity elements to form fine sulfides, carbides, and nitrides to undesirably affect magnetism, so contents thereof are limited to 0.05 wt % or less, respectively.

In addition, one or more of Zr, Mo, and V may be further included in an amount of 0.01 wt % or less, respectively. Since Zr, Mo, V, etc. are also elements strongly forming carbonitrides, it is preferable that they are added as little as possible, and they are included in an amount of 0.01 wt % or less, respectively.

As described above, in the non-oriented electrical steel sheet according to the embodiment of the present invention, sulfides of appropriate size and density are formed including appropriate amounts of Cu, S, P, Ca, and Mg as an alloy component. These sulfides may promote grain growth. Ultimately, it is possible to improve the magnetism and anisotropy of the non-oriented electrical steel sheet.

An average grain size (or diameter) in the microstructure of the electrical steel sheet may be 13.0 to 100.0 μm. When the grain size is too small, the hysteresis loss significantly increases, so that the iron loss worsens. In addition, it is preferable to have an appropriate grain size in order to improve the magnetic flux density due to the effect of fine precipitates and segregation. However, when the grain size is too large, there may be a problem in processing during punching in the coated product after annealing. Specifically, the average grain size may be 13.0 to 40.0 μm.

The grains constituting the non-oriented electrical steel sheet consist of the recrystallized structure in which the non-recrystallized structure processed in the cold rolling process is recrystallized in the final-annealing process, and the recrystallized structure is 99 vol % or more.

As described above, the non-oriented electrical steel sheet according to the embodiment of the present invention has excellent magnetism and anisotropy.

Specifically, in the magnetic flux density ($B_{50}$) induced in a magnetic field of 5000 A/m in the non-oriented electrical steel sheet according to the embodiment of the present invention, an average of the magnetic flux density B50L in a rolling direction (RD direction) and the magnetic flux density B50C in a direction (TD direction) forming a 90 degree angle to the rolling direction may be 1.76 T or more, and a ratio (B50L/B50D) of the magnetic flux density B50L in the rolling direction and the magnetic flux density B50D in a direction forming a 45 degree angle to the rolling direction may be 1.07 or less. Specifically, the average of B50L and B50C may be 1.78 to 1.85 T, and (B50L/B50D) may be 1.00 to 1.05.

The non-oriented electrical steel sheet according to the embodiment of the present invention also has excellent iron loss. Specifically, the iron loss ($W_{15/50}$) when inducing a magnetic flux density of 1.5 T with a frequency of 50 Hz may be 5.5 W/kg or less.

A manufacturing method of a non-oriented electrical steel sheet according to an embodiment of the present invention includes: a step of heating a slab that includes, in wt %: Si: 1.5% or less, C: 0.01% or less (excluding 0%), Mn: 0.03 to 3%, P: 0.01 to 0.2%, S: 0.001 to 0.02%, Al: 0.7% or less (excluding 0%), N: 0.005% or less (excluding 0%), Cu: 0.02 to 0.06%, 0.0001 to 0.005 wt % of Ca and Mg either alone or in total, 0.001 to 0.2 wt % of Sb and Sn either alone or in total, and a balance of Fe and inevitable impurities; a step of manufacturing a hot-rolled sheet by hot-rolling the slab; a step of manufacturing a cold-rolled sheet by cold-rolling the hot-rolled sheet; and a step of final-annealing of the cold-rolled sheet.

Hereinafter, respective steps will be specifically described.

First, the slab is heated. The reason for limiting the addition ratio of each composition in the slab is the same as the reason for limiting the composition of the non-oriented electrical steel sheet described above, so a repeated description will be omitted. The composition of the slab is substantially the same as that of the non-oriented electrical steel sheet because the composition of the slab is not substantially changed during the manufacturing processes such as hot-rolling, annealing of a hot-rolled sheet, cold-rolling, and final-annealing, which will be described later.

The slab may be manufactured by melting steel of a suitable component composition with a converter or a degassing apparatus, and the like, and by performing continuous casting or ingot-blooming rolling.

The slab is fed into a furnace and heated at 1100 to 1250° C. When heated at a temperature exceeding 1250° C., precipitates of AlN and MnS existing in the slab are re-dissolved and then finely precipitated during hot-rolling, so that grain growth may be suppressed and magnetism may be degraded.

When the slab is heated, hot-rolling is performed to 2.0 to 3.5 mm, and the hot-rolled sheet that is hot-rolled is wound. During the hot-rolling, finish rolling in finishing rolling is completed in the ferrite phase region. In addition, during the hot-rolling, a large amount of ferrite-phase expansion elements such as Si, Al, and P may be added, or Mn and C, which are elements that suppress the ferrite phase, may be included less. As described above, when rolling on the ferrite phase, many {100} planes are formed in the texture, and accordingly, magnetism may be improved.

After the manufacturing of the hot-rolled sheet, a step of annealing the hot-rolled sheet may be further performed. In this case, an annealing temperature of the hot-rolled sheet may be 950 to 1200° C. When the annealing temperature of the hot-rolled sheet is excessively low, since the structure does not grow or finely grows, the synergy effect of the magnetic flux density is less, while when the annealing temperature is excessively high, since the magnetic characteristic deteriorates, rolling workability may be degraded due to deformation of a sheet shape. The hot-rolled sheet annealing is performed in order to increase the orientation favorable to magnetism as required, and it may be omitted.

Next, the hot-rolled sheet is pickled and cold-rolled to a predetermined thickness. Although It may be applied differently depending on the thickness of the hot-rolled sheet, the cold-rolling may be performed so that the final thickness thereof becomes 0.3 to 1.0 mm, by applying a reduction ratio of 50 to 95%. The cold rolling may be carried out once, or, as necessary, two or more cold-rollings with intermediate annealing therebetween may be carried out.

The cold-rolled sheet that is cold-rolled is final-annealed (cold-rolled sheet annealed). In the final-annealing process of the cold-rolled sheet, the cracking temperature during the annealing is 800 to 1150° C.

When the cold-rolled sheet annealing temperature is too low, it may be difficult to obtain grains of sufficient size to obtain low iron loss. When the annealing temperature is too high, the plate shape during the annealing is uneven, and the precipitates are re-dissolved at a high temperature and then finely precipitated during cooling to adversely affect the magnetism.

The final-annealed steel sheet may be treated with an insulating film. The method of forming the insulating layer is widely known in the field of non-oriented electrical steel sheet technology, so a detailed description thereof is omitted. Specifically, as a composition for forming the insulating layer, either a chromium-type or a chromium-free type may be used without limitation.

Hereinafter, preferred examples of the present invention and comparative examples will be described. However, the following examples are only preferred examples of the present invention, and the present invention is not limited to the following examples.

Example 1

Molten steel blown in the converter was degassed to melt the steel containing, in wt %, amounts of the following Table 1 and Table 2 and the balance Fe and inevitable impurities, followed by continuous casting to manufacture a slab. The slab was reheated at 1200° C. for 1 hour, and then hot-rolled at a finish rolling temperature of 860° C. to the thickness listed in Table 3 to manufacture a hot-rolled sheet. Each manufactured hot-rolled sheet was wound at a temperature of 700° C. and then annealed in the atmosphere for 60 minutes to simulate the temperature of the hot-rolled coil during coiling.

This was cold-rolled to a thickness of 0.5 mm and then annealed at 850° C. for 35 seconds in a nitrogen atmosphere containing 5% of hydrogen to manufacture a non-oriented electrical steel sheet. From this, an SST test piece having a width of 60 mm×a length of 60 mm was cut out from the rolling direction (L direction) and the direction (D direction) forming 45 degrees to the rolling direction, and in accordance with IEC 60404-3, for measurement of iron loss W15/50 and magnetic flux density B50, and anisotropy, the following (B50L/B50D) were respectively measured, and the results are shown in Table 3.

TABLE 1

| Steel type | C | Si | Mn | P | Al | S |
|---|---|---|---|---|---|---|
| 1 | 0.013 | 0.38 | 0.21 | 0.100 | 0.0080 | 0.0025 |
| 2 | 0.0031 | 1.73 | 0.27 | 0.171 | 0.0020 | 0.0045 |
| 3 | 0.0008 | 0.38 | 3.5 | 0.145 | 0.0030 | 0.0037 |
| 4 | 0.0032 | 0.33 | 0.25 | 0.230 | 0.0030 | 0.0058 |
| 5 | 0.0025 | 0.34 | 0.23 | 0.088 | 1.6300 | 0.0058 |
| 6 | 0.0022 | 0.31 | 0.29 | 0.021 | 0.8500 | 0.0031 |
| 7 | 0.0031 | 0.35 | 0.26 | 0.107 | 0.0070 | 0.0230 |
| 8 | 0.0007 | 0.33 | 0.29 | 0.090 | 0.0010 | 0.0069 |
| 9 | 0.0039 | 0.32 | 0.26 | 0.112 | 0.0050 | 0.0027 |
| 10 | 0.0016 | 0.41 | 0.21 | 0.098 | 0.0020 | 0.0054 |
| 11 | 0.0034 | 0.34 | 0.29 | 0.175 | 0.0050 | 0.0059 |
| 12 | 0.0043 | 0.35 | 0.23 | 0.172 | 0.0100 | 0.0050 |
| 13 | 0.0035 | 0.41 | 0.28 | 0.129 | 0.0060 | 0.0037 |
| 14 | 0.0051 | 0.37 | 0.29 | 0.142 | 0.0020 | 0.0026 |
| 15 | 0.0021 | 0.31 | 0.22 | 0.060 | 0.0006 | 0.0041 |

TABLE 1-continued

| Steel type | C | Si | Mn | P | Al | S |
|---|---|---|---|---|---|---|
| 16 | 0.0032 | 0.35 | 0.26 | 0.096 | 0.0030 | 0.0069 |
| 17 | 0.0022 | 0.38 | 0.26 | 0.119 | 0.0040 | 0.0037 |
| 18 | 0.0032 | 0.34 | 0.20 | 0.088 | 0.0020 | 0.0060 |
| 19 | 0.0023 | 0.41 | 0.02 | 0.086 | 0.0100 | 0.0037 |
| 20 | 0.0015 | 0.38 | 0.27 | 0.003 | 0.0070 | 0.0050 |
| 21 | 0.0023 | 0.39 | 0.20 | 0.163 | 0.0020 | 0.0003 |
| 22 | 0.0025 | 0.35 | 0.28 | 0.178 | 0.0100 | 0.0005 |
| 23 | 0.0039 | 0.32 | 0.29 | 0.091 | 0.0020 | 0.0050 |
| 24 | 0.0012 | 0.32 | 0.29 | 0.057 | 0.0010 | 0.0049 |
| 25 | 0.0023 | 0.34 | 0.22 | 0.083 | 0.0001 | 0.0031 |
| 26 | 0.0043 | 0.32 | 0.28 | 0.082 | 0.0010 | 0.0025 |
| 27 | 0.0031 | 0.40 | 0.25 | 0.103 | 0.0020 | 0.0043 |
| 28 | 0.0023 | 0.33 | 0.29 | 0.064 | 0.0010 | 0.0041 |

TABLE 2

| Steel type | N | Cu | Sb | Sn | Ca | Mg |
|---|---|---|---|---|---|---|
| 1 | 0.0017 | 0.027 | 0.0030 | 0.035 | 0.002 | 0.003 |
| 2 | 0.0039 | 0.025 | 0.0010 | 0.041 | 0.002 | 0.003 |
| 3 | 0.0027 | 0.068 | 0.0030 | 0.031 | 0.003 | — |
| 4 | 0.0030 | 0.046 | 0.0010 | 0.025 | 0.002 | 0.002 |
| 5 | 0.0041 | 0.049 | 0.0020 | 0.032 | — | 0.003 |
| 6 | 0.0030 | 0.025 | 0.0010 | 0.043 | 0.0001 | 0.0001 |
| 7 | 0.0034 | 0.032 | 0.0030 | 0.054 | 0.002 | 0.003 |
| 8 | 0.0061 | 0.055 | 0.0030 | 0.021 | 0.002 | 0.003 |
| 9 | 0.0043 | 0.005 | 0.0030 | 0.025 | 0.001 | 0.003 |
| 10 | 0.0018 | 0.012 | 0.0030 | 0.031 | 0.002 | — |
| 11 | 0.0011 | 0.035 | 0.0030 | 0.020 | — | — |
| 12 | 0.0025 | 0.370 | 0.0010 | 0.025 | 0.001 | — |
| 13 | 0.0036 | 0.031 | 0.2310 | 0.003 | 0.001 | 0.001 |
| 14 | 0.0042 | 0.065 | 0.0020 | 0.231 | 0.001 | — |
| 15 | 0.0022 | 0.030 | 0.0030 | 0.013 | 0.0005 | 0.0003 |
| 16 | 0.0030 | 0.044 | 0.0010 | 0.023 | 0.006 | 0.001 |
| 17 | 0.0033 | 0.022 | 0.0010 | 0.043 | 0.001 | 0.006 |
| 18 | 0.0012 | 0.049 | 0.0003 | 0.0001 | 0.001 | 0.001 |
| 19 | 0.0021 | 0.056 | 0.0040 | 0.035 | 0.0007 | 0.0011 |
| 20 | 0.0037 | 0.040 | 0.0030 | 0.045 | 0.0007 | 0.0003 |
| 21 | 0.0015 | 0.058 | 0.0010 | 0.028 | 0.0001 | 0.0006 |
| 22 | 0.0006 | 0.056 | 0.0020 | 0.038 | 0.0002 | 0.0004 |
| 23 | 0.0017 | 0.060 | 0.0020 | 0.034 | 0.0007 | 0.0003 |
| 24 | 0.0027 | 0.048 | 0.0020 | 0.032 | 0.0009 | 0.0002 |
| 25 | 0.0029 | 0.057 | 0.0300 | 0.022 | — | 0.0005 |
| 26 | 0.0012 | 0.055 | 0.0040 | 0.055 | — | 0.0003 |
| 27 | 0.0015 | 0.033 | 0.0010 | 0.025 | 0.0013 | 0.001 |
| 28 | 0.0023 | 0.021 | 0.0010 | 0.031 | 0.0006 | 0.0001 |

TABLE 3

| Steel type | Hot rolled sheet thickness (mm) | Cold rolled sheet thickness (mm) | W15/50 | B50 | B50L/B50D | Grain size, (μm) | Remarks |
|---|---|---|---|---|---|---|---|
| 1 | 2.56 | 0.5 | 6.089 | 1.757 | 1.081 | 11.2 | Comparative example |
| 2 | 2.61 | 0.5 | 6.077 | 1.746 | 1.06 | 10.1 | Comparative example |
| 3 | 2.05 | 0.5 | 6.098 | 1.758 | 1.063 | 11.6 | Comparative example |
| 4 | 2.47 | 0.5 | 6.107 | 1.72 | 1.066 | 11.4 | Comparative example |
| 5 | 2.57 | 0.5 | 5.974 | 1.722 | 1.067 | 10.1 | Comparative example |
| 6 | 2.53 | 0.5 | 5.6 | 1.705 | 1.061 | 10.8 | Comparative example |
| 7 | 2.92 | 0.5 | 5.946 | 1.716 | 1.065 | 10.4 | Comparative example |
| 8 | 2.32 | 0.5 | 5.977 | 1.755 | 1.079 | 12 | Comparative example |
| 9 | 2.81 | 0.5 | 6.048 | 1.718 | 1.076 | 11.4 | Comparative example |
| 10 | 2.93 | 0.5 | 6.113 | 1.723 | 1.088 | 11.4 | Comparative example |
| 11 | 2.26 | 0.5 | 6.09 | 1.743 | 1.089 | 10.6 | Comparative example |
| 12 | 2.64 | 0.5 | 6.219 | 1.745 | 1.063 | 12.4 | Comparative example |
| 13 | 3 | 0.5 | 6.068 | 1.721 | 1.079 | 10.6 | Comparative example |
| 14 | 2.02 | 0.5 | 5.917 | 1.738 | 1.062 | 10.9 | Comparative example |
| 15 | 2.45 | 0.5 | 6.5 | 1.731 | 1.071 | 10.7 | Inventive example |
| 16 | 2.79 | 0.5 | 6.197 | 1.757 | 1.071 | 12.7 | Comparative example |

TABLE 3-continued

| Steel type | Hot rolled sheet thickness (mm) | Cold rolled sheet thickness (mm) | W15/50 | B50 | B50L/B50D | Grain size, (μm) | Remarks |
|---|---|---|---|---|---|---|---|
| 17 | 2.25 | 0.5 | 5.981 | 1.712 | 1.083 | 11.2 | Comparative example |
| 18 | 2.69 | 0.15 | 6.208 | 1.756 | 1.084 | 11.3 | Comparative example |
| 19 | 2.01 | 0.5 | 6.099 | 1.735 | 1.092 | 10.4 | Comparative example |
| 20 | 2.36 | 0.5 | 6.227 | 1.716 | 1.062 | 10.2 | Comparative example |
| 21 | 2.46 | 0.5 | 6.232 | 1.714 | 1.061 | 11 | Comparative example |
| 22 | 2.9 | 0.5 | 6.135 | 1.725 | 1.065 | 10.4 | Comparative example |
| 23 | 2.28 | 0.35 | 5.173 | 1.763 | 1.047 | 35.9 | Inventive example |
| 24 | 2.32 | 0.35 | 5.158 | 1.773 | 1.051 | 34.6 | Inventive example |
| 25 | 2.91 | 0.5 | 5.382 | 1.8 | 1.05 | 30.9 | Inventive example |
| 26 | 2.92 | 0.5 | 5.459 | 1.767 | 1.037 | 28.7 | Inventive example |
| 27 | 2.25 | 0.5 | 5.517 | 1.786 | 1.057 | 23.1 | Inventive example |
| 28 | 2.57 | 0.5 | 5.272 | 1.806 | 1.056 | 39.7 | Inventive example |

As shown in Table 1 to Table 3, it can be confirmed that the inventive example satisfying all the alloy components according to the embodiment of the present invention is excellent in both magnetic and anisotropy.

On the other hand, it can be confirmed that steel type 1 includes an excessive amount of C, and thus has inferior magnetism and anisotropy.

It can be confirmed that steel type 2 includes an excessive amount of Si, and thus has inferior magnetism and anisotropy.

It can be confirmed that steel type 3 and steel type 19 include an excessive or insufficient amount of Mn, and thus have inferior magnetism and anisotropy.

It can be confirmed that steel type 4 and steel type 20 include an excessive or insufficient amount of P, and thus have inferior magnetism and anisotropy.

It can be confirmed that steel type 5 and steel type 6 include an excessive amount of Al, and thus have inferior magnetism and anisotropy.

It can be confirmed that steel type 9, steel type 23, and steel type 24 include an excessive or insufficient amount of S, and thus have inferior magnetism and anisotropy.

It can be confirmed that steel type 8 includes an excessive amount of N, and thus has inferior magnetism and anisotropy.

It can be confirmed that steel type 9, steel type 10, and steel type 12 include an excessive or insufficient amount of Cu, and thus have inferior magnetism and anisotropy.

It can be confirmed that steel type 13, steel type 14, steel type 15, and steel type 18 include an excessive or insufficient amount of Sb and Sn, and thus have inferior magnetism and anisotropy.

It can be confirmed that steel type 11, steel type 16, and steel type 17 include an excessive or insufficient amount of Ca and Mg, and thus have inferior magnetism and anisotropy.

The present invention may be embodied in many different forms, and should not be construed as being limited to the disclosed embodiments. In addition, it will be understood by those skilled in the art that various changes in form and details may be made thereto without departing from the technical spirit and essential features of the present invention. Therefore, it is to be understood that the above-described embodiments are for illustrative purposes only, and the scope of the present invention is not limited thereto.

The invention claimed is:

1. A non-oriented electrical steel sheet, comprising: in wt %, Si: 1.5% or less, C: 0.01% or less (excluding 0%), Mn: 0.03 to 3%, P: 0.005 to 0.2%, S: 0.001 to 0.02%, Al: 0.7% or less (excluding 0%), N: 0.005% or less (excluding 0%), and Cu: 0.02 to 0.06%;

0.0001 to 0.005 wt % of Ca and Mg either alone or in total;

0.02 to 0.059 wt % of Sb and Sn in total; and a balance of Fe and inevitable impurities, wherein an average of magnetic flux density B50L in a rolling direction and magnetic flux density B50C in a direction forming a 90 degree angle to the rolling direction is 1.76 T or more, and wherein a ratio (B50L/B50D) of the magnetic flux density B50L in the rolling direction and the magnetic flux density B50D in the direction forming a 45 degree angle to the rolling direction is 1.07 or less.

2. The non-oriented electrical steel sheet of claim 1, wherein

Mg is included in an amount of 0.0001 to 0.003 wt %.

3. The non-oriented electrical steel sheet of claim 1, wherein

Ni is further included in an amount of 0.05 wt % or less.

4. The non-oriented electrical steel sheet of claim 1, wherein an average grain size thereof is 13 to 100 μm.

5. The non-oriented electrical steel sheet of claim 1, wherein

Si is included in an amount of 0.50% or less.

* * * * *